US008253120B2

(12) United States Patent
Short et al.

(10) Patent No.: US 8,253,120 B2
(45) Date of Patent: Aug. 28, 2012

(54) FLOOD SOURCE WITH PIGMENTLESS ACTIVE AREA AND VISIBLE BORDER

(76) Inventors: Jason Short, Simi Valley, CA (US); Mike Palatas, North Hollywood, CA (US); L. Michael Cutrer, Huntington Beach, CA (US); Jeff Gabler, Canyon Country, CA (US)

( * ) Notice: Subject to any disclaimer, the term of this patent is extended or adjusted under 35 U.S.C. 154(b) by 603 days.

(21) Appl. No.: 12/533,392

(22) Filed: Jul. 31, 2009

(65) Prior Publication Data

US 2010/0025598 A1 Feb. 4, 2010

Related U.S. Application Data

(60) Provisional application No. 61/085,106, filed on Jul. 31, 2008.

(51) Int. Cl.
*G21G 4/00* (2006.01)

(52) U.S. Cl. ..... 250/493.1; 427/5

(58) Field of Classification Search ..... 250/493.1; 427/5

See application file for complete search history.

(56) References Cited

U.S. PATENT DOCUMENTS

| | | | | |
|---|---|---|---|---|
| 6,086,942 | A | 7/2000 | Carden, Jr. et al. | |
| 6,787,786 | B2 | 9/2004 | Kalas et al. | |
| 7,172,799 | B2 | 2/2007 | Petersen et al. | |
| 2003/0104178 | A1 * | 6/2003 | Petersen et al. | 428/195 |
| 2004/0119030 | A1 * | 6/2004 | Kalas et al. | 250/493.1 |

* cited by examiner

*Primary Examiner* — Michael Maskell

(57) ABSTRACT

Method and/or system for forming a radiation flood source. The radiation flood source includes a paper sheet, a pigmentless radioactive fill printed on the paper sheet, and a pigmented border printed on the paper sheet and around the pigmentless radioactive fill. In one embodiment the radiation flood source is formed by preparing a radioactive isotope carrier solution; loading the radioactive isotope carrier solution into a radioactive isotope carrier solution cartridge; loading a separate border cartridge into a plotter; selecting and configuring a shape of an active area; setting a border to be placed around the active area; printing the active area by utilizing the radioactive isotope carrier solution cartridge on a sheet substrate; and printing the border by utilizing the separate border cartridge on the sheet substrate.

28 Claims, 5 Drawing Sheets

FLOOD SOURCE WITH PIGMENTLESS ACTIVE AREA AND VISIBLE BORDER

CROSS-REFERENCE TO RELATED APPLICATION(S)

This application claims priority to the benefit of U.S. Provisional Application No. 61/085,106, filed on Jul. 31, 2008, the entire content of which is incorporated herein by reference.

BACKGROUND

1. Field

This application relates to products, such as flood sources, that are used to calibrate radiation detection devices, such as gamma cameras.

2. Background of Related Art

Radiation detection devices, such as gamma cameras, often require testing and/or calibration to ensure that their sensitivity is uniform over the area that they detect. Devices that produce a uniform cross-section of radiation, such as a flood source, are commonly used for this purpose.

A flood source typically includes a flat surface, such as a sheet of paper, on which radioactive isotopes are printed. For obvious safety and other reasons, paper that has been impregnated with radioactive isotopes must be readily identifiable as having an active area.

One approach for achieving this has been to mix a radioactive isotope solution with ink before it is printed on the paper, such as is described in U.S. Pat. No. 7,172,799, the entire content of which is incorporated herein by reference. The ink in the active area on the paper remains visible after the mixture is printed, thus signaling that the paper has an active area and where it is.

Mixing ink with the radioactive isotope solution, however, may adversely affect the uniformity of the isotope in the solution. This approach may also require a substantial amount of ink, which may be costly.

SUMMARY

A radioactive carrier solution may be printed on paper without a pigment, such as ink. A visible border, such as a border made of ink, may be printed around this active area. The radioactive isotopes and the ink may be printed at substantially the same time on the same plotter, but through separate print heads.

An embodiment of the present invention provides a method for forming a radiation flood source. The method includes the steps of preparing a radioactive isotope carrier solution; loading the radioactive isotope carrier solution into a radioactive isotope carrier solution cartridge; loading a separate border cartridge into a plotter; selecting and configuring a shape of an active area; setting a border to be placed around the active area; printing the active area by utilizing the radioactive isotope carrier solution cartridge on a sheet substrate; and printing the border by utilizing the separate border cartridge on the sheet substrate.

In one embodiment, the method further includes the steps of laminating the printed sheet substrate to block radioactive isotopes on the active area from separating from the active area; and placing the laminated printed sheet substrate in a protective housing.

In one embodiment, the method further includes the steps of cutting an active sheet around the printed border from the printed sheet substrate; laminating the active sheet to block radioactive isotopes on the active area from separating from the active area; and placing the laminated active sheet in a protective housing.

In one embodiment, the method further includes the steps of cutting an active sheet around the printed border from the printed sheet substrate; laminating the active sheet to block radioactive isotopes on the active area from separating from the active area; testing the laminated active sheet to verify an integrity of the active area; and placing the tested active sheet in a protective housing.

In one embodiment, the step of preparing the radioactive isotope carrier solution includes: drying a radioactive isotope solution to form dried radioactive isotopes; and mixing the dried radioactive isotopes with a pigmentless carrier solution to prepare the radioactive isotope carrier solution.

In one embodiment, the active area is printed only by the radioactive isotope carrier cartridge, and the border is printed only by the border cartridge.

In one embodiment, the radioactive isotope carrier solution includes an active material composed of radioactive isotopes selected from the group consisting of Cobalt 57, Iodine 125, Palladium 103, Barium 133, Carbon 14, Gadolinium 153, Phosphorus 33, Tellurium 99, and combinations thereof. The radioactive isotope carrier solution may be formulated with a pigmentless carrier solution comprising cobalt chloride, ethylene glycol, glycerin, and hydrochloric acid and to have a viscosity adapted for being inkjet printed on the sheet substrate. The pigmentless carrier solution may be composed of a mixture of 600 mg of cobalt chloride, 10 ml ethylene glycol, 10 ml glycerin, and 80 ml of 0.1M hydrochloric acid.

In one embodiment, the radioactive isotope carrier solution is a pigmentless radioactive isotope carrier solution; the step of printing the active area includes printing the active area by utilizing only the pigmentless radioactive isotope carrier solution; the separate border cartridge is composed of a pigmented ink solution; and the step of printing the border includes printing the border around the area by utilizing only the pigmented ink solution.

Another embodiment of the present invention provides a plotting system for forming a radiation flood source. The plotting system includes a sheet substrate supply, a radioactive isotope carrier solution cartridge, a separate border cartridge, and a controller. Here, the sheet substrate supply is configured to provide a sheet substrate. The radioactive isotope carrier solution cartridge contains a radioactive isotope carrier solution and is configured to print an active area onto the sheet substrate. The separate border cartridge is configured to print a border around the active area on the sheet substrate, and the controller is configured to control the radioactive isotope carrier solution cartridge to print the active area onto the sheet substrate and the separate border cartridge to print the border around the active area on the sheet substrate.

In one embodiment, the radioactive isotope carrier solution cartridge is an inkjet cartridge.

In one embodiment, the radioactive isotope carrier solution is a mixture of dried radioactive isotopes and a pigmentless carrier solution.

In one embodiment, the active area is printed only by the radioactive isotope carrier cartridge, and the border is printed only by the border cartridge.

In one embodiment, the radioactive isotope carrier solution includes an active material composed of radioactive isotopes selected from the group consisting of Cobalt 57, Iodine 125, Palladium 103, Barium 133, Carbon 14, Gadolinium 153, Phosphorus 33, Tellurium 99, and combinations thereof.

In one embodiment, the radioactive isotope carrier solution is formulated with a pigmentless carrier solution comprising cobalt chloride, ethylene glycol, glycerin, and hydrochloric acid and to have a viscosity adapted for being inkjet printed on the sheet substrate. The pigmentless carrier solution may be composed of a mixture of 600 mg of cobalt chloride, 10 ml ethylene glycol, 10 ml glycerin, and 80 ml of 0.1M hydrochloric acid.

In one embodiment, the separate border cartridge contains a pigmented solution composed of color pigments selected from the group consisting of black pigments, cyan pigments, yellow pigments, magenta pigments, and combinations thereof.

Another embodiment of the present invention provides a radiation flood source that includes a paper sheet; a pigmentless radioactive fill printed on the paper sheet and comprising radioactive isotopes selected from the group consisting of Cobalt 57, Iodine 125, Palladium 103, Barium 133, Carbon 14, Gadolinium 153, Phosphorus 33, Tellurium 99, and combinations thereof; and a pigmented border printed on the paper sheet and around the pigmentless radioactive fill.

In one embodiment, the radiation flood source further includes a first protective sheet laminated with the paper sheet with the radioactive isotopes therebetween. Here, the radiation flood source may also include a second protective sheet and the paper sheet being laminated between the first protective sheet and the second protective sheet.

In one embodiment, the radiation flood source further includes a housing having an interior space housing the paper sheet with the pigmentless radioactive fill. Here, the radiation flood source may also include a spacer also housed in the interior space of the housing and between an interior side of the housing facing the paper sheet and the paper sheet.

In one embodiment, the pigmentless radioactive fill further includes a pigmentless carrier material.

In one embodiment, the pigmented border includes color pigments selected from the group consisting of black pigments, cyan pigments, yellow pigments, magenta pigments, and combinations thereof.

In one embodiment, the pigmentless radioactive fill is transparent to visible light.

These, as well as other components, steps, features, objects, benefits, and advantages, will now become clear from a review of the following detailed description of illustrative embodiments, the accompanying drawings, and the claims.

BRIEF DESCRIPTIONS OF THE DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

FIGS. 4*a*-4*f* illustrate various sizes, shapes, and types of bordered, pigmentless radioactive areas.

Figure 5A:
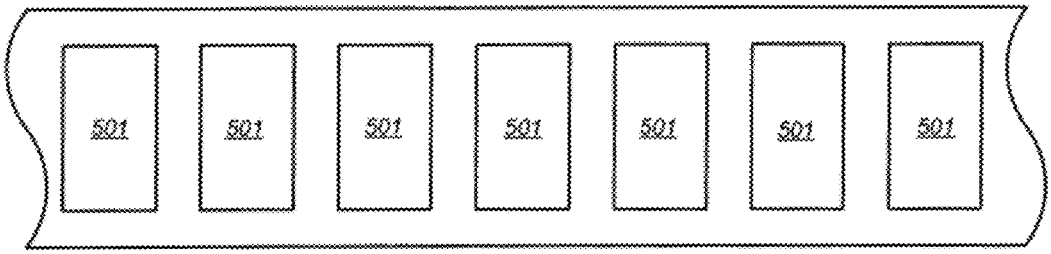
Figure 5B:
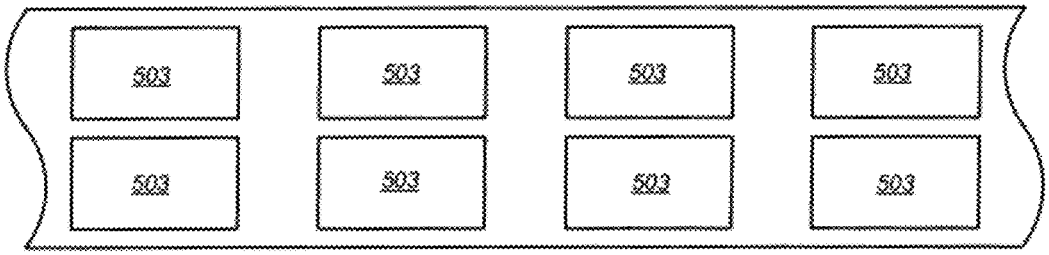

FIGS. 5*a*-5*b* illustrate alternate arrangements of bordered, pigmentless radioactive areas that may be printed on a continuous sheet of paper.

Figure 6:
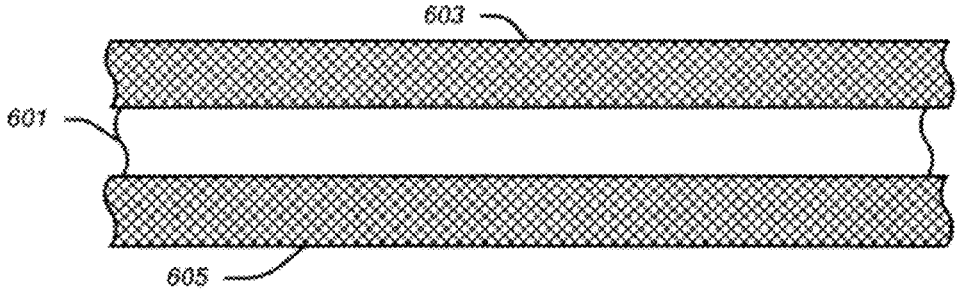

FIG. 6 is a partial cross-section of a laminated sheet of paper containing a bordered, pigmentless radioactive area.

Figure 7:
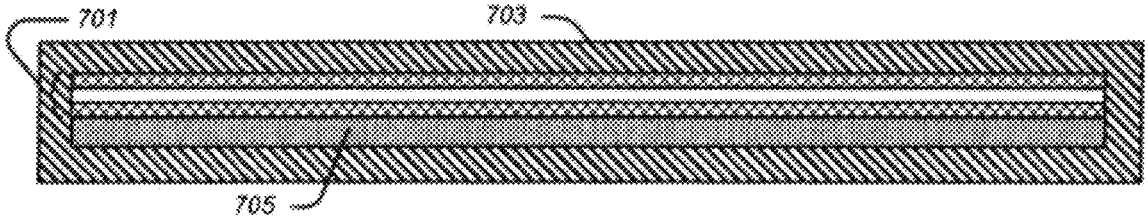

FIG. 7 is a cross-section of a completed flood source.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more affective presentation. Conversely, some embodiments may be practiced without all of the details that are disclosed. Also, in the context of the present application, when an element is referred to as being "on" another element, it can be directly on the another element or be indirectly on the another element with one or more intervening elements interposed therebetween.

Figure 1:
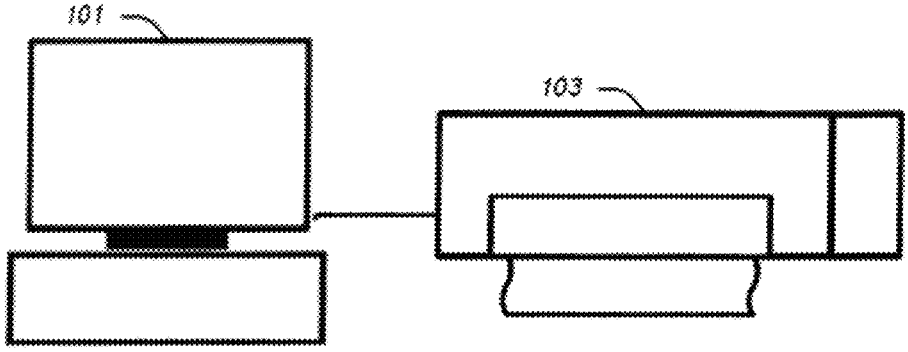
FIG. 1 illustrates a plotting system for printing bordered, pigmentless radioactive areas on paper.

FIG. 1 illustrates a plotting system for printing bordered, pigmentless radioactive areas on paper.

As illustrated in FIG. 1, a computer 101 may be connected to a plotter 103.

The computer 101 may be of any type. The computer 101 may be configured to control the plotter 103 and, in particular, to cause the plotter to print various shapes and borders around those shapes. The computer 101 may be configured to print the borders around the shapes in a color that is different from the fill area within the shape. The computer 101 may be configured to control other typical printing functions, such as paper feeding, paper cutting, and the density of what is printed. The computer 101 may be configured to do the other things discussed herein.

The plotter 103 may be of any type. For example, the plotter 103 may be a wide format plotter, such as a Hewlett-Packard model 450C. The plotter 103 may be configured to print on paper through one or multiple print heads. Each print head may be associated with a cartridge having its own printing solution. The plotter 103 may be configured to feed paper, cut paper, and/or control the location and density of printing on paper. The plotter 103 may be configured to do each or all of these things, as well as the other things discussed herein, in response to commands from a computer, such as the computer 101.

The computer 101 may be connected to the plotter 103 through a wired or wireless connection or both. The connection may be direct or it may be through a local area network and/or wide area network.

Although not illustrated in FIG. 1, multiple plotters may be driven by the computer 101. Similarly, the plotter 103 may be connected to multiple computers.

Figure 2:
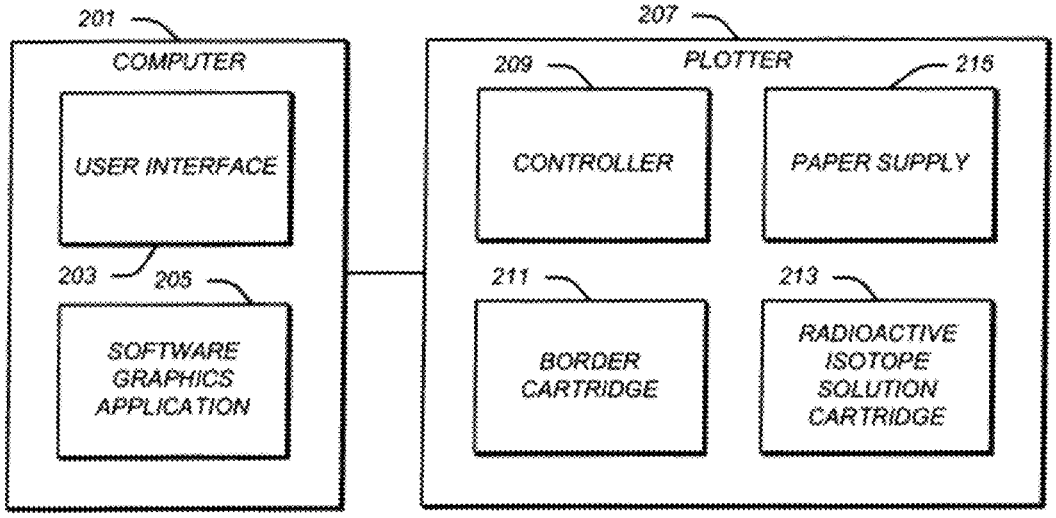
FIG. 2 is a block diagram of a plotting system for printing bordered, pigmentless radioactive areas on paper.

FIG. 2 is a block diagram of a plotting system for printing bordered, pigmentless radioactive areas on paper. The block diagram may be illustrative of the plotting system illustrated in FIG. 1 and/or other types of plotting systems. Similarly, the plotting system illustrated in FIG. 1 may contain components different than those illustrated in FIG. 2.

As illustrated in FIG. 2, the plotting system may include a computer 201. The computer 201 may be the same as the computer 101 or may be different.

The computer 201 may include a user interface 203 and a software graphics application 205.

The user interface 203 may include any type of user interface device, such as a display, touch screen, mouse, and/or keyboard.

The software graphics application 205 may include any type of software graphic application. The application may be configured to enable a user to readily select one or more shapes to be printed, such as one or more squares, rectangles, circles, and/or ovals. The software graphics application 205 may be configured to allow the user to place a border around each shape. The software graphics application 205 may be configured to allow the user to select the color of each border, the thickness of each border, and the color of the fill within the border. The software graphics application 205 may be configured to allow the user to select the density of the border and/or the density of the fill within the border. This selection may be referred to in the software graphics application 205 as the "transparency" of the border and/or the fill. One such software graphics application which may be suitable for the software graphics application 205 is Microsoft Excel.

The software graphics application 205 may enable a user to control the size of the shapes which are selected, the size of the paper on which the shapes are to be printed, and/or the layout of the shapes on the paper.

The plotting system illustrated in FIG. 2 may include a plotter 207. The plotter 207 may be the same as the plotter 103 illustrated in FIG. 1 or it may be different. The plotter 207 may include a controller 209, a border cartridge 211, a radioactive isotope solution cartridge 213, and a paper supply 215. The paper supply 215 may be a single sheet of paper that is manually fed and/or a roll of paper that the plotter 207 is configured to cut under the control of a computer, such as the computer 201.

The paper that may be used in the paper supply 215 may be of any size and/or type. For example, the paper may be coated bond paper, such as HP Product No. C6020B (a thirty-six inch wide roll of coated bond paper) or HP Product No. C6019B (a twenty-four inch wide roll of coated bond paper).

The border cartridge 211 may be any type of cartridge which is configured to hold and deliver pigmented fluid, such as ink. The border cartridge 211 may include an integrated print head, or may be configured to deliver its contents to a separate print head. The pigmented fluid may be of any color, such as black, cyan, yellow, or magenta.

The radioactive isotope solution cartridge 213 may be configured to hold radioactive isotopes in a pigmentless carrier solution and to controllably deliver that isotope solution to a print head. The print head may be integrated with the radioactive isotope solution cartridge 213 or may be separate from it.

The controller 209 may be configured to cause the plotter 207 to perform one or more of the operations that are described herein for a plotter, such as to controllably feed paper from the paper supply 215 past the print heads, to controllably move the print heads to different locations on the paper, and/or to cause one or more of the print heads to print at controllable locations and/or at controllable densities on the paper. The controller 209 may be configured to perform these functions pursuant to commands from a computer, such as the computer 201.

Figure 3:
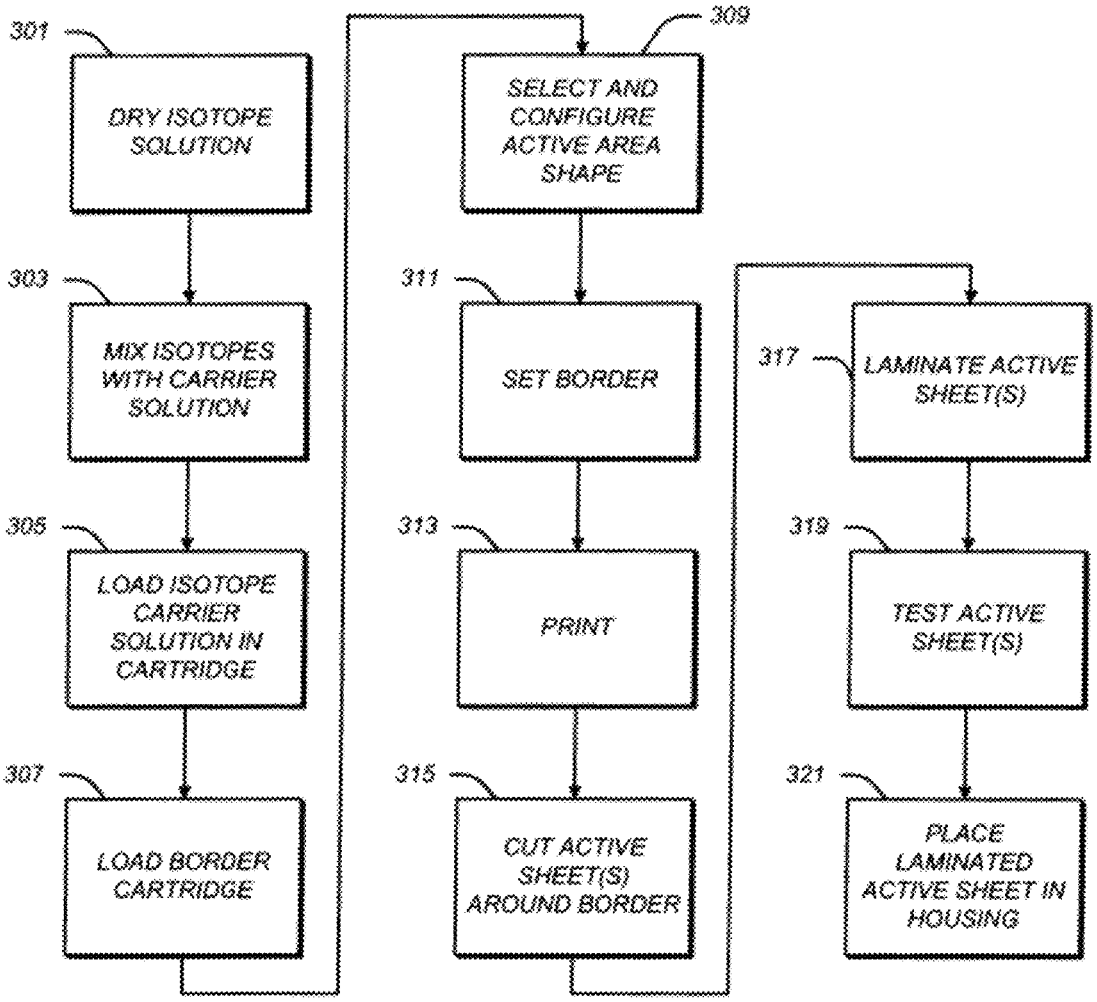
FIG. 3 illustrates a process for printing bordered, pigmentless radioactive areas on paper.

FIG. 3 illustrates a process for depositing a bordered, pigmentless radioactive carrier solution in a confined area on a piece of paper. The process illustrated in FIG. 3 may be implemented by the plotting system illustrated in FIG. 1, FIG. 2, and/or by any other type of plotting system. Similarly, the plotting system illustrated in FIG. 1 or FIG. 2 may be implemented in any other process. The process may include additional steps, may not include all of the steps illustrated in FIG. 3, and/or may perform the steps in a different sequence.

A solution containing radioactive isotopes, such as Cobalt 57 (CO57), Iodine 125 (I-125), or Palladium 103 (Pd103) may be purchased or made. In one embodiment, the radioactive isotopes are Cobalt 57, Iodine 125, Palladium 103, Barium 133, Carbon 14, Gadolinium 153, Phosphorus 33, and/or Tellurium 99. As illustrated in the Dry Isotope Solution step 301, this isotope solution may be dried down to remove the solution from the isotopes. To facilitate the dry down process, heat may be applied. The isotope solution may be allowed to dry under this heat for several hours.

After the isotope solution has dried, a pigmentless carrier solution may be mixed with the dried isotopes, as reflected by a Mix Isotopes with Carrier Solution step 303. During this step, an off-the-shelf, stock, pigmentless carrier solution may be mixed with the dried isotope(s). Alternatively, a custom-made, pigmentless carrier solution may be used, such as a mixture of 600 mg of cobalt chloride (CoCl), 10 ml ethylene glycol, 10 ml glycerin, and 80 ml of 0.1M hydrochloric acid (HCl), or it might be mixed in any other proportion.

The pigmentless, radioactive carrier solution may have a viscosity which is suitable for being deposited on the substrate using a standard or modified inkjet cartridge, such as the radioactive isotope solution cartridge 213 illustrated in FIG. 2. If too thin, the mixed solution may run when printed. If too thick, the mixed solution may not expel smoothly from the radioactive isotope solution cartridge.

The radioactive carrier solution may be pigmentless and thus unobservable to the naked eye after being printed. In other applications, a pigment may be added to the radioactive carrier solution, such as an ink.

The pigmentless radioactive carrier solution may be loaded in a radioactive isotope solution cartridge, such as the radioactive isotope solution cartridge 213 illustrated in FIG. 2, as reflected by a Load Isotope Carrier Solution in Cartridge step 305. In some cases, the radioactive isotope solution cartridge may come preloaded with ink, such as in the case of a Hewlett-Packard No. 40 black ink cartridge. In these instances, the ink may be removed from the radioactive isotope solution cartridge and replaced with the pigmentless radioactive carrier solution. In other cases, the radioactive isotope solution cartridge 213 may be purchased empty, such as in the case of other compatible brands of empty cartridges.

A border cartridge, such as the border cartridge 211, may be loaded in the plotter, as reflected by a Load Border Cartridge step 307. The border cartridge 211 may be purchased preloaded with ink or have ink added to it.

An active area shape may be selected and configured, as reflected by a Select and Configure Active Area Shape step 309. During this step, the user may communicate through a user interface, such as the user interface 203, with a software graphics application, such as the software graphics application 205. The communication may cause the software graphics application to select a pre-defined shape, such as a square, rectangle, circle, or oval. The communication may also specify a fill for the shape, such as a uniform color, and the transparency of the fill. The communication may also specify a size for the shape. The communication may also specify the number of shapes and how they are to be placed and arranged on one or more sheets of paper.

The communication may designate that a border is to be placed around the shape, as reflected by a Set Border step 311. The communication may specify a color for the border, its thickness, and its transparency.

The communication may specify that the color of the border be different than the fill. More particularly, the communication may specify a color for the border which the software graphics application and the plotter may assign exclusively to the border cartridge within the plotter, such as to the border cartridge 211 in the plotter 207. Similarly, the user may select a color for the fill of a shape which the software graphics application and the plotter may assign exclusively to the radioactive isotope solution cartridge, such as to the radioactive isotope solution cartridge 213 in the plotter 207. In this way, the border will be printed only by border cartridge and the fill will be printed only by the radioactive isotope solution cartridge 213.

FIGS. 4A-4F illustrate various sizes, shapes, and types of bordered, pigmentless radioactive areas. Each of these areas, as well as areas of different sizes, shapes and types, may be selected by the user through the use of the software graphics application 205.

Figure 4A:
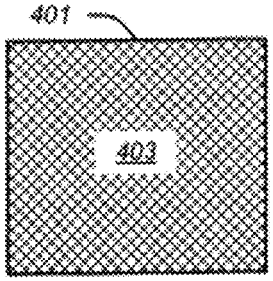

FIG. 4A illustrates a radioactive area that is square. The area includes a thin border 401 and a fill (e.g., a pigmentless radioactive fill or an active area) 403.

Figure 4B:
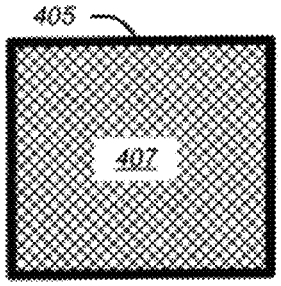

FIG. 4B also illustrates a radioactive area that is square with a border 405 and a fill (e.g., a pigmentless radioactive fill or an active area) 407. The border 405 in FIG. 4B, however, may be thicker than the border 401 in FIG. 4A.

Figure 4C:
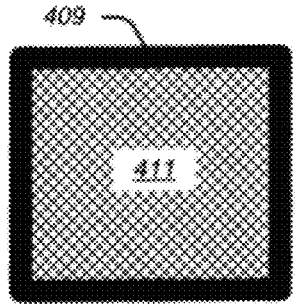

FIG. 4C also illustrates a radioactive area which is square, with a border 409 and a fill (e.g., a pigmentless radioactive fill or an active area) 411. This square is similar to the squares illustrated in FIGS. 4A and 4B, except that the border 409 is even thicker.

FIGS. 4A-4C thus illustrate variations in the thickness of the border that may be selected during the Set Border step 311.

Figure 4D:
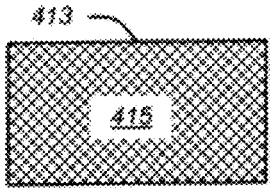

FIG. 4D illustrates a radioactive shape which is rectangular and which includes a border 413 and a fill 415.

Figure 4E:
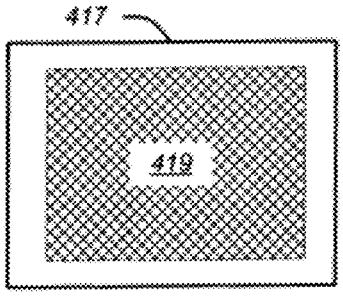

FIG. 4E also illustrates a radioactive shape which is rectangular with a border 417 and a fill (e.g., a pigmentless radioactive fill or an active area) 419. FIG. 4E is similar to FIG. 4D, except that the border 417 is spaced from the fill 419.

Figure 4F:
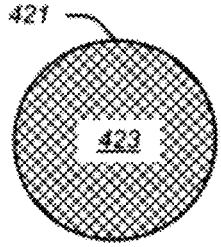

FIG. 4F illustrates a radioactive shape that is circular which includes a border 421 and a fill (e.g., a pigmentless radioactive fill or an active area) 423.

FIGS. 4D-4F thus illustrate that the shape of the radioactive area may be other than square and that the border may be spaced from the fill.

Fills 403, 407, 411, 415, 419, and 423 are illustrated in FIGS. 4A-4F, respectively, with a cross-hatch pattern. It is to be understood that no such cross-hatch pattern may in fact appear when the shape is printed. To the contrary, the fill may not be in any way visible to the naked eye because it may be pigmentless.

After the attributes of the shape have been selected and configured, and after the user has specified how the shape is to be printed on the paper, the user may direct the computer to print one or more instances of the selected and configured shape on paper by a plotter, as reflected by a Print step 313. As part of this step, the plotter may respond by printing in accordance with the selections and configurations that were made. This may include, for example, cutting the length of paper on a roll to the length set by the user.

FIGS. 5A-5B illustrate alternate arrangements of bordered, pigmentless radioactive areas that may be printed on a continuous sheet of paper. These areas are illustrated as rectangular. FIG. 5A illustrates each rectangular shape 501 being printed with its longest dimension running across the width of the paper, while FIG. 5B illustrates each rectangular shape 503 being printed with its longest dimension running transverse to the width of a paper, but in a stacked configuration. Any other type of layout may be used in addition or instead.

The layout may be set by the user when using the software graphics application 205, by the application itself so as to best utilize the surface area of the paper, and/or by the plotter. Although FIGS. 5A-5B illustrate only replicas of the same shape being printed during a single run, different shapes may in addition or instead be printed during such a single run.

FIGS. 5A and 5B also illustrate shapes being printed on a roll of paper. Through appropriate commands from the computer and/or the plotter, the plotter may cause the roll of paper to be cut between each shape or between each set of stacked shapes, while the printing is ongoing. The plotter may in addition or instead print each shape and/or set of shapes on separate sheets of paper, fed automatically or manually.

After the shapes are printed on the paper, each shape may be cut from the paper, as reflected by a Cut Active Sheet(s) Around Border step 315. During this step, non-active paper outside of the border of each shape may be removed. In some cases, a small frame of non-active paper around the border of each shape may be permitted to remain, such as a frame that is between one and two inches wide. In other applications, the shape may be cut at the outer edge of its border, within its border, at the inner edge of its border, or in any other way.

The presence of a visible border around each pigmentless active area may serve a multitude of purposes. For example, the visible border may serve to signal that the radioactive isotope has been printed on the paper, thus providing a safety function. The visible border also provides a convenient means for identifying where cuts should be made to remove non-active paper on which no printing has taken place or at least portions thereof.

Each active sheet may be laminated, as reflected by a Laminate Active Sheet(s) step 317. During this step, each side of an active sheet may be laminated, so as to prevent radioactive isotopes from separating from each sheet, potentially creating a hazard.

FIG. 6 is a partial cross-section of a laminated sheet of paper containing a bordered, pigmentless radioactive area. As illustrated in FIG. 6, a sheet of paper 601 containing a bordered, pigmentless radioactive area is protected on one side by a protective sheet 603 and on the other side by a protective sheet 605. The protective sheets 603 and 605 may be made of any material, but are typically a transparent plastic film suitable for use with any commercially available, heat-applying laminating machine. The protective sheets may cover all of the active area on the paper 601. The protective sheets 603 and 605 may extend beyond the active area to the perimeter of the paper 601 or beyond.

In some cases, the lamination process may result in the protective sheets 603 and 605 extending well beyond the perimeter of the paper 601. In this instance, excessive portions of the protective sheets 603 and 605 may be cut off.

The protective sheets 603 and 605 may be affixed to the paper 601 by any means, such as by an adhesive The surfaces of the paper 601 may in addition or instead be sealed through application of a liquid sealant which may thereafter dry into a hard surface.

The printed paper may be tested to verify the integrity of the radioactive area on the paper. The testing may seek to verify the shape of the active area, its homogeneity, and/or any other desired characteristic, as reflected by a Test Active Sheet(s) step 319.

Each laminated, active sheet may be placed in a protective housing, as reflected by a Place Laminated Active Sheet in Protective Housing step 321. The finished product may then be distributed as flood source.

FIG. 7 is a cross-section of a completed flood source. As illustrated in FIG. 7, a laminated, active sheet 701 may be placed within a central slot of a protective housing 703. A spacer 705 may be provided to ensure that the laminated, active sheet 701 fits snugly within the central slot of the protective housing and to ensure that its surface is parallel to the surface of the protective housing 703, thus maximizing the uniformity of its radiation.

The protective housing 703 may be made of any material. For example, it may be made of acrylic or ABS.

The spacer 705 may similarly be made of any type of material. For example, it may be made of foam.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

For example, each of the printed shapes thus-far have been described as being uniformly filled with radioactive isotopes. In other applications, the filling may not be uniform, but may have a desired gradient or other pattern. For example, a pattern of stripes or rings may be printed. A hatch pattern may in addition or instead be printed.

A plotter which is directed to make an active area completely uniform may fail to do so, particularly when it has just started to print. Instead of printing a uniform distribution of the isotope across the surface of a shape, for example, the distribution may have a discernible gradient.

Printed sheets which fail to provide the desired degree of uniformity may be discarded. However, the radioactive isotopes may be expensive. Instead of discarding such non-uniform printed sheets, two such sheets may be placed back-to-back with their gradients in opposite directions. This may create a combined sheet which may then have the desired degree of uniformity.

Thus far, each shape has been described as having a visible border completely around it. In other applications, only a partial border may be provided. For example, each of the rectangular shapes 503 in FIG. 5A may not have any visible border, but may instead be separated from one another by a visible, vertical demarcation line.

The isotope carrier solution has also thus-far been described as being pigmentless. In some applications, a pigment such as ink may be included.

Plotters have thus-far been described as being useful for transferring the active isotope to paper. In some applications, other devices may be used, such as "laser" type printers.

Isotopes have thus-far been described as being printed on paper. In other applications, sheets of material other than paper may be used, such as films, such as Mylar®, or acetate.

The radioactive isotopes and the borders around them have thus-far been described as being printed at the same time, albeit through different heads. In other applications, the border and the radioactive isotopes may be printed at different times e.g., during different traverses of the paper past the print heads.

The border and the radioactive isotopes have thus-far been described as being printed through separate heads. In some applications, a single print head with appropriate multiplexing technology may instead be used to print both.

Nothing that has been stated or illustrated is intended to cause any dedication to any component, step feature, object, benefit, advantage, or equivalent to the public, regardless of how it has been expressed.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method for forming a radiation flood source, the method comprising:

preparing a radioactive isotope carrier solution;

loading the radioactive isotope carrier solution into a radioactive isotope carrier solution cartridge;

loading a separate border cartridge into a plotter;

selecting and configuring a shape of an active area;

setting a border to be placed around the active area;

printing the active area by utilizing the radioactive isotope carrier solution cartridge on a sheet substrate; and printing the border by utilizing the separate border cartridge on the sheet substrate.

2. The method of claim 1, further comprising:

laminating the printed sheet substrate to block radioactive isotopes on the active area from separating from the active area; and placing the laminated printed sheet substrate in a protective housing.

3. The method of claim 1, further comprising:

cutting an active sheet around the printed border from the printed sheet substrate;

laminating the active sheet to block radioactive isotopes on the active area from separating from the active area; and placing the laminated active sheet in a protective housing.

4. The method of claim 1, further comprising:

cutting an active sheet around the printed border from the printed sheet substrate;

laminating the active sheet to block radioactive isotopes on the active area from separating from the active area;

testing the laminated active sheet to verify an integrity of the active area; and placing the tested active sheet in a protective housing.

5. The method of claim 1, wherein the preparing of the radioactive isotope carrier solution comprises:

drying a radioactive isotope solution to form dried radioactive isotopes; and mixing the dried radioactive isotopes with a pigmentless carrier solution to prepare the radioactive isotope carrier solution.

6. The method of claim 1, wherein the active area is printed only by the radioactive isotope carrier cartridge, and the border is printed only by the border cartridge.

7. The method of claim 1, wherein the radioactive isotope carrier solution comprises an active material composed of radioactive isotopes selected from the group consisting of Cobalt 57, Iodine 125, Palladium 103, Barium 133, Carbon 14, Gadolinium 153, Phosphorus 33, Tellurium 99, and combinations thereof.

8. The method of claim 7, wherein the radioactive isotope carrier solution is formulated with a pigmentless carrier solution comprising cobalt chloride, ethylene glycol, glycerin, and hydrochloric acid and to have a viscosity adapted for being inkjet printed on the sheet substrate.

9. The method of claim 8, wherein the pigmentless carrier solution is composed of a mixture of 600 mg of cobalt chloride, 10 ml ethylene glycol, 10 ml glycerin, and 80 ml of 0.1M hydrochloric acid.

10. The method of claim 1, wherein:

the radioactive isotope carrier solution is a pigmentless radioactive isotope carrier solution;

the printing of the active area comprises printing the active area by utilizing only the pigmentless radioactive isotope carrier solution;

the separate border cartridge comprises a pigmented ink solution; and the printing of the border comprises printing the border around the area by utilizing only the pigmented ink solution.

11. A plotting system for forming a radiation flood source comprising:

a sheet substrate supply configured to provide a sheet substrate;

a radioactive isotope carrier solution cartridge containing a radioactive isotope carrier solution and configured to print an active area onto the sheet substrate;

a separate border cartridge configured to print a border around the active area on the sheet substrate; and a controller configured to control the radioactive isotope carrier solution cartridge to print the active area onto the sheet substrate and the separate border cartridge to print the border around the active area on the sheet substrate.

12. The plotting system of claim 11, wherein the radioactive isotope carrier solution cartridge is an inkjet cartridge.

13. The plotting system of claim 11, wherein the radioactive isotope carrier solution is a mixture of dried radioactive isotopes and a pigmentless carrier solution.

14. The plotting system of claim 11, wherein the active area is printed only by the radioactive isotope carrier cartridge, and the border is printed only by the border cartridge.

15. The plotting system of claim 11, wherein the radioactive isotope carrier solution comprises an active material composed of radioactive isotopes selected from the group consisting of Cobalt 57, Iodine 125, Palladium 103, Barium 133, Carbon 14, Gadolinium 153, Phosphorus 33, Tellurium 99, and combinations thereof.

16. The plotting system of claim 11, wherein the radioactive isotope carrier solution is formulated with a pigmentless carrier solution comprising cobalt chloride, ethylene glycol, glycerin, and hydrochloric acid and to have a viscosity adapted for being inkjet printed on the sheet substrate.

17. The plotting system of claim 16, wherein the pigmentless carrier solution is composed of a mixture of 600 mg of cobalt chloride, 10 ml ethylene glycol, 10 ml glycerin, and 80 ml of 0.1M hydrochloric acid.

18. The plotting system of claim 11, wherein the separate border cartridge contains a pigmented solution composed of color pigments selected from the group consisting of black pigments, cyan pigments, yellow pigments, magenta pigments, and combinations thereof.

19. A radiation flood source comprising:

a paper sheet;

a pigmentless radioactive fill printed on the paper sheet and comprising radioactive isotopes selected from the group consisting of Cobalt 57, Iodine 125, Palladium 103, Barium 133, Carbon 14, Gadolinium 153, Phosphorus 33, Tellurium 99, and combinations thereof; and a pigmented border printed on the paper sheet and around the pigmentless radioactive fill.

20. The radiation flood source of claim 19, further comprising:

a first protective sheet laminated with the paper sheet with the radioactive isotopes therebetween.

21. The radiation flood source of claim 20, further comprising a second protective sheet and the paper sheet being laminated between the first protective sheet and the second protective sheet.

22. The radiation flood source of claim 21, further comprising a housing having an interior space housing the paper sheet with the pigmentless radioactive fill.

23. The radiation flood source of claim 22, further comprising a spacer also housed in the interior space of the housing and between an interior side of the housing facing the paper sheet and the paper sheet.

24. The radiation flood source of claim 19, further comprising a housing having an interior space housing the paper sheet with the pigmentless radioactive fill.

25. The radiation flood source of claim 24, further comprising a spacer also housed in the interior space of the housing and between an interior side of the housing facing the paper sheet and the paper sheet.

26. The radiation flood source of claim 19, wherein the pigmentless radioactive fill further comprises a pigmentless carrier material.

27. The radiation flood source of claim 19, wherein the pigmented border comprises color pigments selected from the group consisting of black pigments, cyan pigments, yellow pigments, magenta pigments, and combinations thereof.

28. The radiation flood source of claim 19, wherein the pigmentless radioactive fill is transparent to visible light.

* * * * *